United States Patent [19]

Krob et al.

[11] Patent Number: 4,506,905

[45] Date of Patent: Mar. 26, 1985

[54] APPARATUS FOR FACILITATING A LONGITUDINAL ADJUSTMENT OF SKI-BINDING PARTS

[75] Inventors: Erwin Krob; Helmut Bauer, both of Vienna, Austria

[73] Assignee: TMC Corporation, Baar, Switzerland

[21] Appl. No.: 372,405

[22] Filed: Apr. 27, 1982

[30] Foreign Application Priority Data

Apr. 28, 1981 [AT] Austria ..... 1892/81

[51] Int. Cl.[3] ..... A63C 9/00

[52] U.S. Cl. ..... 280/633; 280/636

[58] Field of Search ..... 280/633, 636, 634, 618, 280/607, 11.26; 441/70

[56] References Cited

U.S. PATENT DOCUMENTS

| | | | |
|---|---|---|---|
| 3,913,931 | 10/1975 | Kratky | 280/633 |
| 4,022,493 | 5/1977 | Weigl et al. | 280/633 |
| 4,210,342 | 6/1980 | Krob et al. | 280/636 |

FOREIGN PATENT DOCUMENTS

| | | | |
|---|---|---|---|
| 332774 | 10/1976 | Austria | 280/636 |
| 1954512 | 5/1970 | Fed. Rep. of Germany | 280/636 |
| 2635409 | 2/1978 | Fed. Rep. of Germany | 280/633 |
| 2634321 | 2/1978 | Fed. Rep. of Germany | 280/633 |
| 3015478 | 11/1980 | Fed. Rep. of Germany | 280/633 |
| 556674 | 12/1974 | Switzerland | 280/633 |

*Primary Examiner*—David M. Mitchell

*Attorney, Agent, or Firm*—Flynn, Thiel, Boutell & Tanis

[57] ABSTRACT

An apparatus for facilitating a longitudinal adjustment of ski-binding parts having a guide rail adapted to be fastened on the ski and being provided with two laterally spaced guide tracks. The guide rail has a toothed bar which extends in longitudinal direction of the apparatus, with which toothed bar is associated a locking member which is provided on a slide plate. The slide plate is covered by a guide plate which is supported on the guide rail and which carries a ski-binding part. In each of the guide plate and slide plate there is arranged a recess, and if desired, a shoulder for the two compression springs which bias the guide plate. An extension member is operatively connected to the slide plate for facilitating a movement of the locking member on the slide plate against the force of the compression springs to effect a disengagement from the toothed bar on the guide rail. The extension member extends in transverse direction of the apparatus and is adapted to be manually operated.

23 Claims, 5 Drawing Figures

APPARATUS FOR FACILITATING A LONGITUDINAL ADJUSTMENT OF SKI-BINDING PARTS

FIELD OF THE INVENTION

The invention relates to an apparatus for facilitating a longitudinal adjustment of ski-binding parts, comprising a guide rail which is adapted to be fastened to a ski and has two laterally spaced guide tracks, which guide rail is provided with a toothed bar which extends in the longitudinal direction of the apparatus and which has associated with it a locking member which is provided on a slide plate, wherein the slide plate is covered by a guide plate movably supported on the guide rail, which guide plate has a ski-binding part thereon and in each of the guide plate and the slide plate there is arranged a recess and, if desired, a shoulder for two compression springs which bias the guide plate.

BACKGROUND OF THE INVENTION

In a conventional design of this type (see Austrian Pat. No. 345 136, which corresponds to U.S. Pat. No. 4,210,342), the slide plate consisted of two parts. One of the parts has a recess therein for the two compression springs and the other part has the locking member designated for engagement with two toothed bars. Both parts are connected by a coupling. The locking member itself is held in engagement with the toothed bars by a screw.

Another object of the invention is to simplify the conventional construction and moreover to construct it more compactly, so that the entire apparatus is essentially oriented under the ski-binding part. This object is achieved according to the invention primarily by securing or resting on the slide plate extension member which extends in transverse direction of the apparatus and can be manually operated, through which extension member the locking member on the slide plate can become disengaged from the toothed bar of the guide rail against the force of the compression springs. Thus, the compression springs are used, aside from the usual urging of the ski-binding part toward the ski boot, to keep the locking member in engagement with the toothed bar, so that a separate screw for securing the locking member, which can be released or tightened only with difficulty and with a tool, is not needed. Therefore, the adjusting operation is substantially simplified, especially since for the adjustment, only a thumb is needed.

In order to assure an even force transmission of the two springs and to prevent a canting of the guide plate, according to a further characteristic of the invention the toothed bar is arranged in the center of the guide rail.

According to a different characteristic of the invention the extension member or a part of same is housed in a recess of the guide plate, which recess extends in transverse direction. In order for the extension member to provide appropriate leverage the extension member is as long as possible so as to overcome the spring forces. Further, the extension member is arranged in the region of a transverse plane which extends between one of the ends of the two springs engaging the guide plate, and the locking member. Should the force, which is applied by the extension member and comes from the compression springs, however, be reduced due to the fact that the extension member itself carries out a certain lever action at the start of the unlocking operation, then it is, however, sufficient to arrange the extension member in the region of the transverse plane which is placed through the ends of the springs which rest on the guide plate.

Of course the extension member and with it the locking member is sufficiently secured through the force of the two compression springs usually in the locked position of the apparatus. However, in extreme cases it may happen, that through a branch or the like which projects from the snow the extension member is operated unintentionally and thus the ski-binding part is released and longitudinal movement occurs. In order to also exclude these cases, a further development of the invention provides that the extension member is secured against an unintended movement in transverse direction of the apparatus.

Various possibilities are offered for the aforementioned type of lock as for example a push button which is biased by a spring and which must be pressed in prior to the extension member being able to be swivelled and moved in. However, it has been proven as a particularly simple construction if, according to the invention, the extension member is provided with a step which rests on the guide plate under the bias of the compression springs. In this manner, it is not necessary to use further elements for enhancing the securement.

To avoid an involuntary opening of the locking member, and according to a different characteristic of the invention, the step is arranged on the side of the extension member facing the end of the ski. The opening operation in this construction is initiated by a movement against the direction of travel of the ski.

Various constructive solutions are also possible for the design or shape of the extension member. Thus, according to a first inventive solution, the extension member has a slotted hole which extends in transverse direction and receives a bolt therethrough which is anchored on the guide plate and is positioned normally on same. The extension member carries a cam on the side which is associated with the slide plate, the transverse plane of which cam is spaced from the slotted hole and with which it slides along the slide plate as soon as it is pivoted about the axis of the bolt. After the swivelling operation is finished, when the extension member is so to speak in the unlocked position, the extension member can be pressed in unhindered and thus the locking member on the slide plate can be pressed out of engagement with the toothed bar.

According to a different inventive solution, the extension member has side surfaces which converge outwardly in a top view and has a front surface which, in a locked position, engages a side of the slide plate. A further step is provided on the side of the extension member remote from the first step and is supported under the pressure of the compression springs on a projection on the guide plate. If the extension member is to be unlocked, the second step is first moved along the projection, and at the same time the extension member is swivelled until the latter rests on the projection. A pressing in of the extension member is now easily possible in this position.

To assure a reliable resting of the thumb on the extension member and to prevent a sliding off of the same, the outer side of the extension member is inventively provided with an edging, the grooves of which extend vertically.

BRIEF DESCRIPTION OF THE DRAWINGS

The drawings illustrate three exemplary embodiments of the inventive apparatus facilitating a longitudinal adjustment of the ski-binding parts. More specifically.

DETAILED DESCRIPTION

Figure 1:
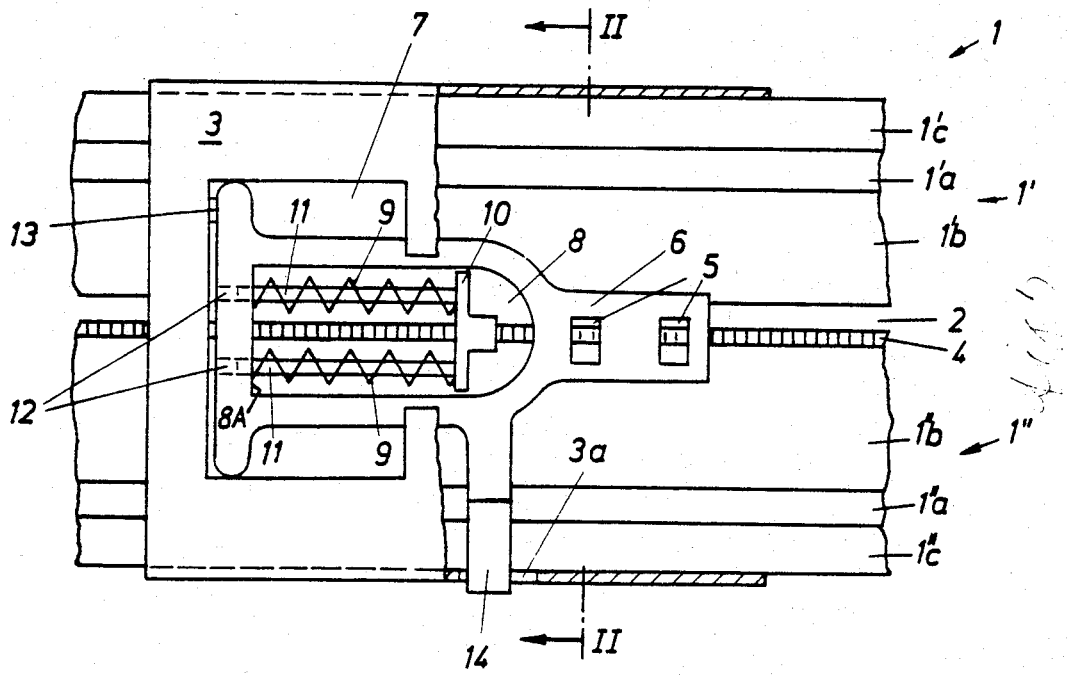
FIG. 1 is a top view of a first exemplary embodiment, wherein the guide plate which carries the ski-binding part is partially broken away for a clearer illustration.
Figure 2:
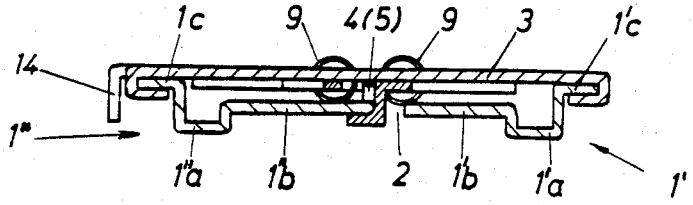
FIG. 2 is a cross-sectional view taken along the line II—II of FIG. 1 of the apparatus in the locked condition.
Figure 3:
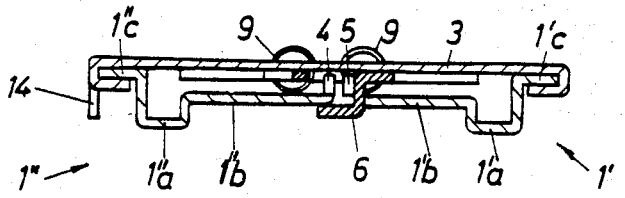
FIG. 3 is a cross-sectional view of the apparatus similar to FIG. 2 but in the disengaged condition.

The apparatus according to FIGS. 1 to 3 includes a guide rail 1 adapted to be secured to the upper surface of the ski. The guide rail consists of two parts 1' and 1'' separated by a longitudinal slot 2 and connected only at the not illustrated opposite ends thereof. Each of the parts 1' or 1'' has a section 1'*a* or 1''*a* intermediate the width thereof which is U-shaped in cross section. A generally flat flange 1'*b* or 1''*b* extends from each of the U-shaped sections toward a vertically oriented longitudinal center plane of the ski. Further, a flange 1'*c* or 1''*c* extends outwardly from each of the U-shaped sections. The two flanges 1'*c*, 1''*c* form guide tracks for a guide plate 3 on which a ski-binding part (not illustrated) is secured. The flange 1''*b* which is the left U-shaped segment in FIGS. 2 and 3 carries at its free end a vertically arranged, upwardly directed toothed rack or bar 4, which lockingly cooperates with teeth on a locking member 5 arranged on a locking part or slide plate 6.

The slide plate 6 is movably supported between the structure of the guide rail 1 and the guide plate 3. The slide plate has, just like the guide plate 3 which is provided with a recess 7, a recess 8 which extends in the longitudinal direction of the apparatus. Two compression springs 9 are located in the recesses 7, 8, and are supported at their one end on the boundary edge 8A of the recess 8 and at their other end on a shoulder 10 of the guide plate 3. A pair of parallel guide rods 11 are located in a groove 12 in the slide plate 6 and extend longitudinally through the center of each spring. The end of the slide plate 6 remote from the locking member 5 is urged, if no ski boot is in the ski binding, by the compression springs 9 into engagement with a support 13 arranged on the guide plate 3 spaced laterally offset from the vertical longitudinal center plane of the apparatus. In this manner a torque is applied onto the slide plate 6, which urges the locking member 5 into a meshing engagement with the toothed bar 4. If, however, a ski boot is introduced into the ski binding, the guide plate 3 which carries the ski-binding part thereon is moved against the urging of the two springs 9 to the left in FIG. 1, which results in a compressing of the two springs between the shoulder 10 on the guide plate 3 and the edge 8A of the recess 8. The slide plate 6 will remain fixed due to the locking member being engaged with the toothed bar 4.

An elongated extension 14 is arranged on and extends sidewardly from the side of the slide plate 6 on a side thereof which is remote from the support 13, i.e., on the opposite of the vertical longitudinal center plane of the apparatus. The extension 14 forms a member facilitating an engagement of a thumb of the user and which is multiply bent in the region of the left guide bar 1''*c* in FIGS. 2 and 3. The member 14 is guided adjacent its bent end in a recess 3*a* of the guide plate 3 providing adequate lateral clearance.

If the ski-binding part is to be adjusted in longitudinal direction of the ski, the extension member 14 is first pressed in from the locked position, according to FIG. 2 against the action of the torque which is applied by the two springs 9 by the thumb of the user, toward the vertical longitudinal center plane of the ski. Through this, however, the slide plate 6 is slightly pivoted about an axis defined by the support 13, so that the locking member 5 becomes disengaged from the toothed bar 4 (see FIG. 3). The guide plate 3 with the ski-binding part mounted thereon can now be adjusted as desired in the longitudinal direction of the ski. When the desired new position of the ski-binding part is achieved, the extension member 14 is released by the thumb of the user and the locking member 5 engages by itself, under the urging of the torque which is applied by the two compression springs 9, the toothed bar 4.

Figure 4:
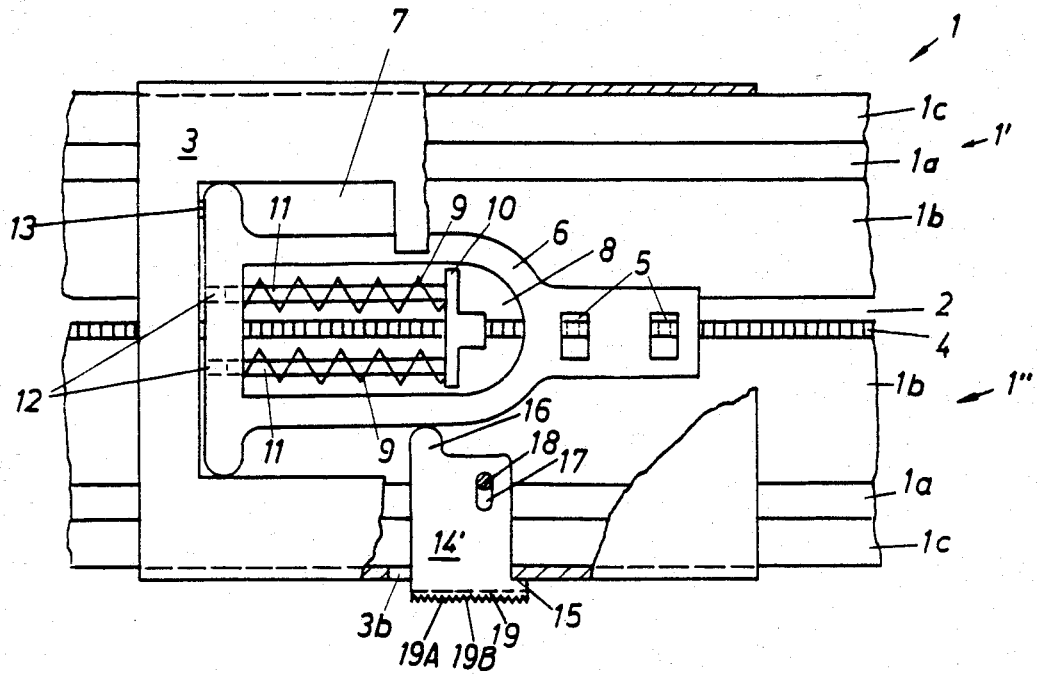
FIGS. 4 and 5 illustrate a top view of a second and third exemplary embodiment, respectively, wherein again the guide plate is partially broken away to provide better clarity.
Figure 5:
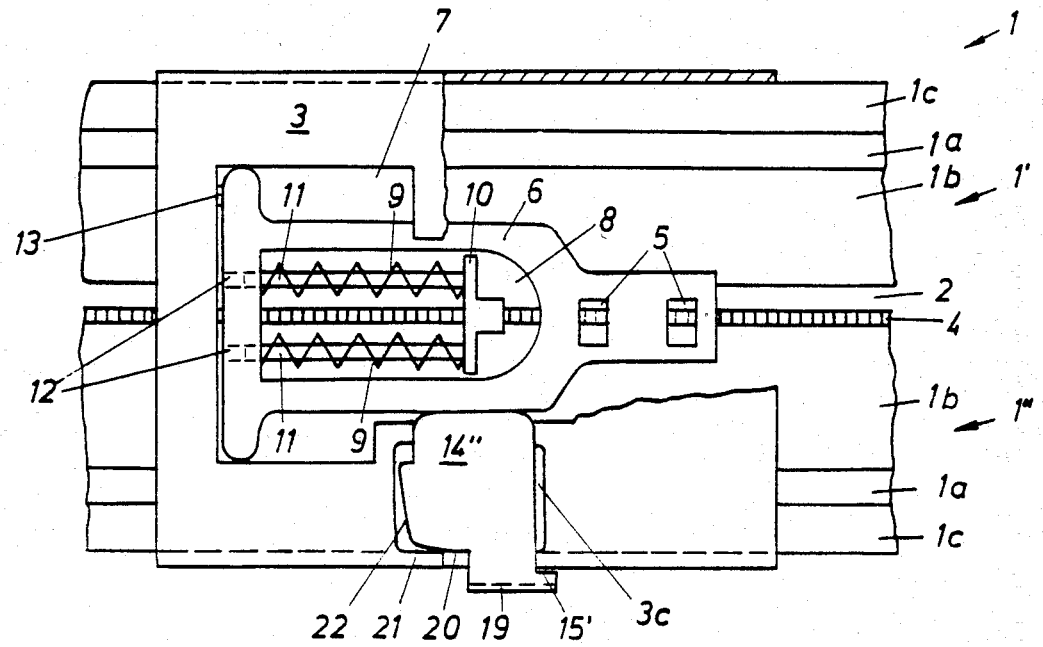

While in the exemplary embodiment according to FIGS. 1 to 3 the extension member 14 is not secured against an involuntary movement during skiing, the exemplary embodiments according to FIGS. 4 and 5 are equipped with safety locking mechanisms for this purpose. The extension member is in both exemplary embodiments not constructed as an integral extension of the slide plate 6, but as a member separate therefrom, which member is housed in a recess 3*b* (FIG. 4) or 3*c* (FIG. 5) in the guide plate 3. Only the end of each which faces the vertical longitudinal center plane of the ski engages the slide plate 6.

According to FIG. 4, the extension member 14' is shaped in the top view thereof substantially rectangularly. It has a step 15 on one side, which step is provided for engagement with the guide plate 3. The extension member 14' carries at the end which is adjacent to the slide plate 6 a cam 16. Furthermore, a slotted hole 17 is provided and extends in the transverse direction of the apparatus, which slotted hole 17 has a bolt or pin 18 received therein and is anchored to the guide plate 3 and which is positioned perpendicularly to the plane of the member 14'. The extension member 14' is housed with sufficient clearance in the recess 3*b* of the guide plate 3, so that not only a movement in the transverse direction but also a swivelling of the extension member at a pregiven angle is possible. To facilitate for these two movements the engagement of the extension member by the thumb of the user, the vertical surface of the extension member 14', which surface extends outside of the lateral edges of the guide plate 3 and is designated for engagement by the thumb, is provided with a vertically extending edging 19.

In the engaged or locked position of the slide pate 6, the step 15 of the extension member 14' engages the edge of the guide plate 3 (see FIG. 4), caused by the two compression springs 9, which due to the support 13 on the slide plate apply a torque and thus cause the extension member 14' to be urged counter-clockwise in FIG. 4 due to its engagement with the cam 16.

If the ski-binding part which is secured on the guide plate 3 is to be adjusted in the longitudinal direction of the ski, the member 14' is first pivoted about the axis of the bolt 18 in the clockwise direction by the thumb of the user until the left side thereof, remote from the step 15, engages the left side of the recess 3*b*. This causes the step 15 to be lifted off from the edge of the guide plate 3 and the cam 16 slides along the side surface of the slide plate 6. When this position of the member 14' is reached, the member 14' is pressed in toward the vertical longitudinal center plane of the ski by the thumb of the user against the torque which is applied by the two compression springs 9. However, this has the consequence that the locking member 5 is moved away from the toothed bar 4. The guide plate 3 can thus be adjusted as desired in the longitudinal direction of the ski. However, as soon as the thumb of the user is lifted off from the member 14', the two compression springs 9 urge the locking member 5 again into meshing engagement with the toothed bar 4 and the member 14' returns to its initial position and the locked condition of the apparatus is again created.

A similar embodiment is illustrated in FIG. 5. Here too the member 14'' is housed in a recess 3*c* in the guide plate 3 and has a step 15' on the right side thereof preventing the member from being pressed in by mistake. However, the member 14'' differs from the member 14' according to FIG. 4 in that it rests in engaged or locked condition of the apparatus with its entire front surface on the side surface of the slide plate 6. Furthermore, a second step 20 is provided on the side of the member 14'', remote from the step 15' and rests upon release of the lock on a projection 21 of the guide plate 3 and by means of which the member 14'' is prevented from falling out of the apparatus. The surface 22 which is contiguous to the step 20 is arranged so as to extend inclined with respect to the transverse direction, i.e., a perpendicular to the vertical central longitudinal plane.

In the engaged position, or in other words when the locking member 5 engages the toothed bar, the step 20 is urged against the projection 21 or against the edge of the recess 3*c* due to the torque which is applied by the two compression springs 9. The two parts 14'' and 6 thereby rest flatly on one another as shown. If, however, the ski-binding part which is mounted on the guide plate 3 is to be adjusted in longitudinal direction of the ski, the member 14'' is first swung by the thumb of the user clockwise until the left step 20 engages the projection 21 of the guide plate 3. The surface 22 of the member 14'' extends in this position approximately parallel with respect to the adjacent surface of the recess 3*c*, and between the member 14'' and the slide plate 6 there no longer exists a surface contact, but only a vertical line contact. It is possible to press in the member 14'' toward the vertical longitudinal center plane of the ski with the thumb of the user in transverse direction of the ski against the action of the torque which is applied by the two springs 9. With this, however, the slide plate 6 is pivoted about the support 13 and the locking member 5 becomes disengaged from the toothed bar 4. A movement of the guide plate 3 in longitudinal direction of the ski can now take place. If, however, the thumb of the user is removed from the member 14'', the torque which is applied by the compression springs effects a return of the slide plate 6 into its engaged or locked position wherein the locking member 5 again engages the toothed bar 4. Of course the compression member 14'' also returns into its initial position.

To enhance an engagement of the thumb with extension member, the outwardly facing surface 19A of the edging 19 is provided with grooves 19B or the like which extend in a vertical direction.

The invention is by no means to be limited to the exemplary embodiments which are illustrated in the drawings and are described above. Rather various modifications of the same are possible without departing from the scope of the invention. For example, embodiments wherein there are provided no special supports for the slide plates and the torque applied to the slide plate is caused exclusively by its lateral deflection, fall under the scope of the invention.

The embodiments of the invention in which an exclusive property or privilege is claimed are defined as follows:

1. An apparatus for facilitating longitudinal adjustment of a ski-binding part on a ski, comprising: a guide rail adapted to be fastened on the ski, having two laterally spaced guide tracks extending longitudinally thereof, and having a toothed bar which extends longitudinally thereof; a slide plate having a locking member thereon which is engageable with said toothed bar; a guide plate which is provided over said slide plate, which is movably supported on said guide rail, and which carries a ski-binding part, wherein said guide plate and said slide plate each have a recess therein; two compression springs which each have first and second ends which are respectively supported on said guide plate and said slide plate, and which urge said slide plate to move relative to said guide plate; and extension means operatively coupled to said slide plate for facilitating movement of said slide plate against the force of said compression springs so as to effect disengagement of said locking member thereon from said toothed bar on said guide rail, said extension means extending transversely of the ski and being adapted to be manually operated, said extension means being approximately aligned in directions longitudinally of the ski with said first ends of said springs; wherein said extension means includes a step, and wherein said slide plate is urged against said extension means by said compression springs and urges said extension means in a direction causing said step to move into engagement with a portion of said guide plate.

2. The apparatus according to claim 1, wherein said toothed bar is arranged in the center of said guide rail.

3. The apparatus according to claim 1, wherein said extension means extends through a recess which is provided in said guide plate and which extends in a transverse direction.

4. The apparatus according to claim 1, wherein said extension means includes means for preventing unintended movement thereof in a transverse direction toward said slide plate.

5. The apparatus according to claim 1, wherein said step is on a side of said extension means facing the rear end of the ski.

6. The apparatus according to claim 1, wherein said extension means has a slot therein which extends in a transverse direction and slidably receives a bolt which is anchored in said guide plate and extends normal thereto.

7. The apparatus according to claim 6, wherein said extension means carries a cam on a side thereof facing said slide plate, said cam being spaced from a transverse plane which is parallel to and extends through said slot.

8. The apparatus according to claim 1, wherein said extension means has side surfaces which converge in a top view and has a front surface which, in a locked position of the apparatus, engages said slide plate.

9. The apparatus according to claim 1, wherein said extension means has, on a side which is opposite said step, a further step which is urged by said slide plate against a portion of said guide plate in response to the urging of said compression springs.

10. The apparatus according to claim 1, wherein an outwardly facing surface of said extension means is provided with an edging defined by a plurality of vertically extending grooves.

11. An apparatus for facilitating longitudinal adjustment of a ski binding part on a ski, comprising: a guide rail adapted to be fastened on the ski and having means defining a toothed rack which extends in a first direction approximately parallel to a longitudinal axis of the ski; a guide plate supported on said guide rail for reciprocal movement in directions approximately parallel to said first direction and adapted to have the ski binding part mounted thereon, said guide plate having means defining a recess in a side wall thereof; a locking part supported for pivotal movement relative to said guide plate about a generally vertical axis between first and second positions, said locking part having means defining a recess therein and having a locking member thereon which respectively engages and is free from engagement with said toothed rack when said locking part is in its first and second positions; resilient means for yieldably urging said locking part to pivot from its second position to its first position relative to said guide plate, said resilient means including a spring disposed in said recess in said locking part and having its ends respectively supported on said locking part and said guide plate; and a manually operable extension which operatively cooperates with said locking part and extends approximately horizontally in a second direction approximately normal to said first direction through said recess in said side wall of said guide plate and which is movable relative to said guide plate, manual movement of said extension causing said extension to move said locking part from its first position to its second position against the urging of said resilient means.

12. The apparatus according to claim 11, wherein said guide rail has two laterally spaced bars, said guide plate being movably supported on said bars, and said locking part being a slide plate which is movably supported between said bars on said guide rail and between said guide rail and said guide plate.

13. The apparatus according to claim 12, wherein said extension is an integral part of said locking part.

14. The apparatus according to claim 12, wherein said toothed rack is arranged intermediate said bars of said guide rail.

15. The apparatus according to claim 12, wherein said spring is a helical compression spring which extends approximately in said first direction, and wherein said locking member and said end of said spring supported on said guide plate are located on opposite sides of a transverse plane which extends normal to said first direction and extends through said extension.

16. The apparatus according to claim 12, wherein said extension is arranged in the region of a transverse plane which extends normal to said first direction and is located adjacent said end of said spring which is supported on said guide plate.

17. The apparatus according to claim 16, including holding means for resisting unintended movement of said extension in a direction which would cause it to move said slide plate away from said first position thereof.

18. The apparatus according to claim 17, wherein said holding means includes said extension having a step which is yieldably urged toward a position engaging said guide plate by the urging of said spring.

19. The apparatus according to claim 18, wherein said extension is a platelike element separate from and movable independently of said slide plate, and wherein said step is on a side of said extension which faces the rear end of the ski.

20. The apparatus according to claim 19, wherein said extension has a slot which extends transversely of said first direction, said slot slidably receiving a bolt which is anchored on and extends normal to said guide plate.

21. The apparatus according to claim 20, wherein said extension has a cam on a side thereof which faces said slide plate, said cam being spaced from a transverse plane which extends normal to said first direction and extends through said slot.

22. The apparatus according to claim 19, wherein said extension has side surfaces which converge away from said slide plate in a top view thereof, and has a front side which can slidably engage said slide plate.

23. The apparatus according to claim 22, wherein said extension has on a side thereof opposite from said first-mentioned step a further step which is yieldably urged toward a position engaging a projection on said guide plate by the urging of said spring.

* * * * *